US007390244B2

(12) United States Patent
Woo et al.

(10) Patent No.: US 7,390,244 B2
(45) **Date of Patent: *Jun. 24, 2008**

(54) ABRASIVE ARTICLE MOUNTING ASSEMBLY AND METHODS OF MAKING SAME

(75) Inventors: Edward J. Woo, Woodbury, MN (US); Thomas W. Rambosek, Woodbury, MN (US); Rufus C. Sanders, Jr., Burnsville, MN (US); Ehrich J. Braunschweig, Woodbury, MN (US); Seyed A. Angadjivand, Woodbury, MN (US); Suresh Kalatoor, Cottage Grove, MN (US); Curtis J. Schmidt, South St. Paul, MN (US); Charles R. Wald, Oakdale, MN (US); Donna W. Bange, Eagan, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 216 days.

This patent is subject to a terminal disclaimer.

(21) Appl. No.: 11/229,277

(22) Filed: Sep. 16, 2005

(65) Prior Publication Data

US 2007/0066199 A1 Mar. 22, 2007

(51) Int. Cl.
*B24D 11/00* (2006.01)

(52) U.S. Cl. ..... 451/533

(58) Field of Classification Search ..... 451/340, 451/360, 353, 342, 343, 540, 295, 296, 297, 451/527, 532, 533
See application file for complete search history.

(56) References Cited

U.S. PATENT DOCUMENTS

| | | | |
|---|---|---|---|
| 1,850,413 | A | 3/1932 | Porte |
| 1,862,103 | A | 6/1932 | Stratford |
| 1,961,911 | A | 6/1934 | Pusch |
| 2,123,581 | A | 7/1938 | Anderson |
| 2,740,239 | A | 4/1956 | Ball et al. |
| 2,749,681 | A | 6/1956 | Reidenbach |
| 2,838,890 | A | 6/1958 | McIntyre |
| 2,984,052 | A | 5/1961 | Mueller, Jr. |
| 3,021,649 | A | 2/1962 | Robbins |
| 3,353,308 | A | 11/1967 | Zane |

(Continued)

FOREIGN PATENT DOCUMENTS

DE 34 16 186 A1 1/1985

(Continued)

OTHER PUBLICATIONS

U.S. Appl. No. 11/321,505, Woo et al., filed Dec. 29, 2005.

(Continued)

*Primary Examiner*—Jacob K. Ackun, Jr.

(57) ABSTRACT

An abrasive article mounting assembly with an integral dust collection system. The abrasive attachment interface is configured to releasably engage and support an abrasive article, such as, for example, a porous abrasive sheet or disc.

34 Claims, 2 Drawing Sheets

U.S. PATENT DOCUMENTS 3,420,007 A 1/1969 Kolesh
3,795,933 A * 3/1974 Seufert ..... 15/114
3,861,892 A 1/1975 Wisdom, Jr. et al.
3,932,966 A 1/1976 Stern
4,001,366 A 1/1977 Brumlik
4,062,152 A 12/1977 Mehrer
4,158,935 A 6/1979 Robert
4,282,011 A 8/1981 Terpay
4,287,685 A 9/1981 Marton
4,437,269 A 3/1984 Shaw
4,590,113 A 5/1986 Herzog
4,609,581 A 9/1986 Ott
4,631,220 A 12/1986 Clifton
4,645,699 A 2/1987 Neveu
4,722,203 A 2/1988 Darjee
4,725,487 A 2/1988 Pemrick et al.
4,759,155 A 7/1988 Shaw
4,844,967 A 7/1989 Goralski et al.
4,920,702 A 5/1990 Kloss et al.
4,932,163 A 6/1990 Chilton et al.
4,937,984 A 7/1990 Taranto
4,964,243 A 10/1990 Reiter
4,964,245 A 10/1990 Braasch
5,007,206 A 4/1991 Paterson
5,036,627 A 8/1991 Walters
5,131,924 A 7/1992 Wiand
5,254,194 A 10/1993 Ott et al.
5,256,231 A 10/1993 Gorman et al.
5,317,886 A 6/1994 Prahl
5,354,591 A 10/1994 Ott et al.
5,367,839 A 11/1994 Pearce
5,389,032 A 2/1995 Beardsley
5,458,532 A 10/1995 Cannone
5,490,878 A 2/1996 Peterson et al.
5,505,747 A 4/1996 Chesley et al.
5,533,923 A 7/1996 Shanouilian et al.
5,560,794 A 10/1996 Currie et al.
5,578,343 A 11/1996 Gaeta et al.
5,607,345 A 3/1997 Barry et al.
5,616,394 A 4/1997 Gorman et al.
5,667,540 A 9/1997 Chesley et al.
5,674,122 A 10/1997 Krech
5,679,441 A * 10/1997 Saelens et al. ..... 428/198
5,695,533 A 12/1997 Kardys et al.
5,807,161 A 9/1998 Manor et al.
5,810,650 A 9/1998 Jöst
5,891,549 A 4/1999 Beretta et al.
5,904,793 A 5/1999 Gorman et al.
5,954,844 A 9/1999 Law et al.
5,989,112 A 11/1999 Long et al.
6,024,634 A 2/2000 Höglund et al.
6,059,644 A 5/2000 Manor et al.
6,074,292 A 6/2000 Gilday
6,077,156 A 6/2000 Amin et al.
6,077,601 A 6/2000 DeVoe et al.
6,190,246 B1 2/2001 Parrott et al.
6,197,076 B1 3/2001 Braunschweig et al.
6,280,824 B1 8/2001 Insley et al.
6,312,325 B1 11/2001 Van Osenbruggen
6,368,199 B1 4/2002 Van Osenbruggen
6,482,308 B1 11/2002 Wiemann
6,575,821 B2 6/2003 Jöst
6,579,162 B2 6/2003 Chesley et al.
6,613,113 B2 9/2003 Minick et al.
6,790,126 B2 9/2004 Wood et al.
6,923,840 B2 8/2005 Schutz et al.
2001/0044006 A1 11/2001 Kruegler
2003/0003856 A1 1/2003 Swei
2003/0127108 A1 7/2003 Policicchio et al.
2003/0143938 A1 7/2003 Braunschweig et al.
2003/0159363 A1 8/2003 Chesley et al.
2004/0098923 A1 5/2004 Hood et al.
2004/0109978 A1 6/2004 Michel
2004/0148866 A1 8/2004 Krupnick
2004/0166788 A1 8/2004 Travis
2004/0170801 A1 9/2004 Seth et al.
2004/0170802 A1 9/2004 Seth et al.
2004/0209561 A1 10/2004 Suzuki et al.
2005/0124274 A1 6/2005 Hoglund
2006/0019579 A1 1/2006 Braunschweig

FOREIGN PATENT DOCUMENTS

DE 41 24 520 A1 1/1993
DE 201 11 245 U 1 8/2001
EP 0 064 748 8/1984
EP 0 244 934 11/1987
EP 0 166 060 9/1988
EP 0 285 042 A1 10/1988
EP 0 578 865 A1 1/1994
EP 0 738 562 10/1996
EP 1 488 888 A1 12/2004
EP 1 524 077 A1 4/2005
EP 1 733 844 A1 12/2006
FR 2 659 892 9/1991
FR 2 739 308 4/1997
GB 1137556 12/1968
GB 1539477 1/1970
GB 2 017 485 A 10/1979
GB 2 057 483 A 4/1981
GB 2 162 213 A 1/1986
GB 2 199 053 A 6/1988
JP 5-220670 8/1993
JP 11-179668 7/1999
WO WO 90/14039 11/1990
WO WO 96/07509 3/1996
WO WO 00/64634 11/2000
WO WO 03/020474 A1 3/2003

OTHER PUBLICATIONS

U.S. Appl. No. 11/198,265, Woo et al., filed Aug. 5, 2005.
U.S. Appl. No. 11/197,798, Woo et al., filed Aug. 5, 2005.
U.S. Appl. No. 11/228,896, Rambosek et al., filed Sep. 16, 2005.
U.S. Appl. No. 11/229,281, Woo et al., filed Sep. 16, 2005.
U.S. Appl. No. 29/238,541, Braunschweig et al., filed Sep. 16, 2005.
U.S. Appl. No. 29/238,542, Braunschweig et al., filed Sep. 16, 2005.
U.S. Appl. No. 29/238,556, Braunschweig et al., filed Sep. 16, 2005.
U.S. Appl. No. 29/246,256, Shimizu et al., filed Mar. 28, 2006.
U.S. Appl. No. 29/246,257, Shimizu et al., filed Mar. 28, 2006.
U.S. Appl. No. 29/246,258, Shimizu et al., filed Mar. 28, 2006.
U.S. Appl. No. 29/246,259, Shimizu et al., filed Mar. 28, 2006.
U.S. Appl. No. 29/246,260, Shimizu et al., filed Mar. 28, 2006.
U.S. Appl. No. 29/246,261, Shimizu et al., filed Mar. 28, 2006.
U.S. Appl. No. 29/253,148, Braunschweig et al., filed Feb. 1, 2006.
U.S. Appl. No. 29/253,110, Braunschweig et al., filed Feb. 1, 2006.
U.S. Appl. No. 29/253,085, Braunschweig et al., filed Feb. 1, 2006.
U.S. Appl. No. 29/253,084, Braunschweig et al., filed Feb. 1, 2006.
"robAust", Roberlo Abrasives,Copyright © 2002-2006 robAust Pty Ltd., [retrieved from the internet on Jul. 6, 2006], URL <http://www.robaust.com/shopdisplayproducts.asp?id=30 &cat=Roberlo+Abrasives>, pp. 2.
"List of Products", Roberlo United States, © Copyright 2003 Roberloroberlousa.com, roberlo.com), [retrieved from the internet on Jan. 7, 2004], URL <http://www.roberlousa.com/abrasives.htm>, pp. 2.
U.S. Appl. No. 11/614,431, Rambosek et al., filed Dec. 21, 2006.
U.S. Appl. No. 11/688,497, Woo et al., filed Mar. 20, 2007.
U.S. Appl. No. 11/688,482, Woo et al., filed Mar. 20, 2007.

* cited by examiner

ABRASIVE ARTICLE MOUNTING ASSEMBLY AND METHODS OF MAKING SAME

FIELD OF INVENTION

The present invention relates generally to an abrasive article mounting assembly that can releasably engage an abrasive article. More particularly, the present invention relates to an abrasive article mounting assembly with an integral dust collection system.

BACKGROUND

Abrasive articles are used in industry for abrading, grinding, and polishing applications. They can be obtained in a variety of converted forms, such as belts, discs, sheets, and the like, in many different sizes.

Generally, when using abrasives articles in the form of "sheet goods" (i.e., discs and sheets), a back-up pad is used to mount or attach the abrasive article to the abrading tool. One type of back-up pad has dust collection holes connected by a series of grooves. The dust collection holes are typically connected to a vacuum source to help control swarf build-up on the abrading surface of the abrasive article. Removing the swarf, dust, and debris from the abrading surface is known to improve the performance of the abrasive article.

Some abrasive tools have integral vacuum systems with dust collection means. The extracting and holding capabilities of these abrasive tools have been limited, in part, due to the suction requirements current abrasive disks and their related back-up pads require.

In some abrasive tool configurations, swarf is collected in a complex dust collection system through a hose connected to the abrasive tools. Dust collection systems, however, are not always available for the abrasive tool operator. Further, the use of a dust collection system requires hoses that can be cumbersome and may interfere with the operator's manipulation of the abrasive tool.

There is a continuing need for alternative ways to provide an abrasive system with dust extraction capabilities. It would be particularly desirable to provide an abrasive system that can be used with or without a central vacuum system.

SUMMARY

The present disclosure relates generally to an abrasive article mounting assembly that can releasably engage an abrasive article. More particularly, the present disclosure relates to an abrasive article mounting assembly with an integral dust collection system.

In one aspect, the present disclosure provides an abrasive article mounting assembly comprising an abrasive attachment interface, a first filter media comprising a plurality of discrete channels formed by a plurality of channel sidewalls having a height in the range of 1 to 20 millimeters, a second filter media, and an assembly attachment layer. The abrasive attachment interface cooperates with the channels to allow the flow of particles from the abrasive attachment interface to the second filter media.

The abrasive attachment interface is configured to releasably engage and support an abrasive article, such as, for example, a porous abrasive sheet or disc. The porous abrasive sheet or disc can be a perforated coated abrasive, a screen abrasive, a nonwoven abrasive, or otherwise. The assembly attachment layer is allows the abrasive article mounting assembly to be mounted to an abrasive tool, such as, for example, a rotary sander.

In some aspects, the channel sidewalls of the first filter media comprise polymer film. The polymer film can comprises a polymer selected from the group consisting of polypropylene, polyethylene, polytetrafluoroethylene, and combinations thereof. The polymer film can have a structured surface and/or can have an electrostatic charge.

In another aspect of the abrasive article mounting assembly of the present disclosure, an abrasive article mounting assembly comprising a plurality of channels formed by a plurality of polymer films configured as a stack and affixed to one another is disclosed. The channels extend from the first surface of the first filter media to the second surface of the first filter media.

In another aspect, the present disclosure provides methods for making abrasive article mounting assemblies with integral dust collection capabilities.

The above summary of the abrasive article mounting assembly of the present disclosure is not intended to describe each disclosed embodiment of every implementation of the abrasive article mounting assembly of the present disclosure. The Figures and the detailed description that follow more particularly exemplify illustrative embodiments. The recitation of numerical ranges by endpoints includes all numbers subsumed with that range (e.g., 1 to 5 includes 1, 1.5, 2, 2.75, 3, 4, 4.80, and 5).

These figures, which are idealized, are intended to be merely illustrative of the abrasive article mounting assembly of the present disclosure and non-limiting.

DETAILED DESCRIPTION

Figure 1A:
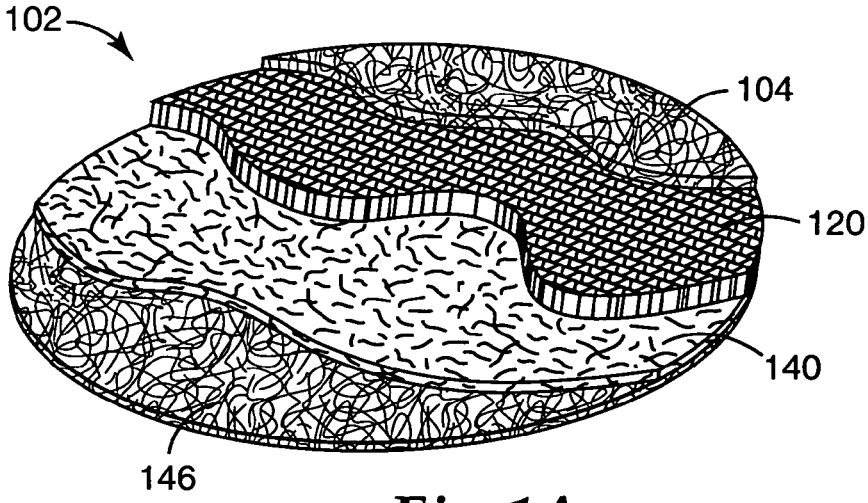
FIG. 1A is a perspective view of an exemplary abrasive article mounting assembly according to the present disclosure partially cut away to reveal the layers forming the assembly.

FIG. 1A shows a perspective view of an exemplary abrasive article mounting assembly 102 with a partial cut away. As shown in FIG. 1, the abrasive article mounting assembly 102 has an abrasive attachment interface 104, a first filter media 120, a second filter media 140, and an assembly attachment layer 146.

Figure 1B:
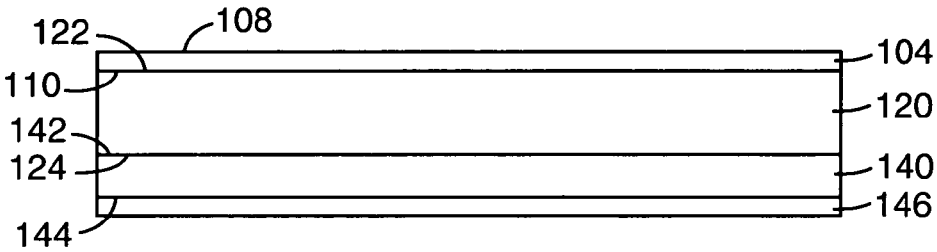
FIG. 1B is a cross-sectional view of the abrasive article mounting assembly shown in FIG. 1A.

FIG. 1B shows a cross-sectional view of the abrasive article mounting assembly shown in FIG. 1A. As shown in FIG. 1B, the abrasive article mounting assembly 102 comprises multiple layers. The first filter media comprises a first surface 122 and a second surface 124 opposite the first surface 122. The second filter media 140 comprises a first surface 142 and a second surface 144 opposite the first surface 142. The first surface 122 of the first filter media 120 is proximate the abrasive attachment interface 104. The second surface 124 of the first filter media 120 is proximate the first surface 142 of the second filter media 140. An assembly attachment layer 146 is proximate the second surface 144 of the second filter media 140.

The abrasive attachment interface 102 is configured to releasably engage and support an abrasive article, such as, for example, a porous abrasive sheet or disc. The porous abrasive sheet or disc can be a perforated coated abrasive, a screen abrasive, a nonwoven abrasive, or otherwise. The abrasive attachment interface comprises a plurality of openings that allow the flow of particles through the abrasive attachment interface 104. The particles are then captured by the filter media within the abrasive article mounting assembly.

The abrasive attachment interface of the abrasive article mounting assembly of the present disclosure can consist of a non-continuous layer of adhesive, a sheet material, or a combination thereof. The sheet material can comprise, for example, a loop portion or a hook portion of a two-part mechanical engagement system. In other embodiment, the abrasive attachment interface comprises a layer of pressure sensitive adhesive with an optional release liner to protect it during handling.

In some embodiments, the abrasive attachment interface of the abrasive article mounting assembly of the present disclosure comprises a nonwoven, woven or knitted loop material. Suitable materials for a loop abrasive attachment interface include both woven and nonwoven materials. Woven and knit abrasive attachment interface materials can have loop-forming filaments or yarns included in their fabric structure to form upstanding loops for engaging hooks. Nonwoven loop attachment interface materials can have loops formed by the interlocking fibers. In some nonwoven loop attachment interface materials, the loops are formed by stitching a yarn through the nonwoven web to form upstanding loops.

Useful nonwovens suitable for use as a loop abrasive attachment interface include, but are not limited to, airlaids, spunbonds, spunlaces, bonded melt blown webs, and bonded carded webs. The nonwoven materials can be bonded in a variety of ways known to those skilled in the art, including, for example, needle-punched, stichbonded, hydroentangled, chemical bond, and thermal bond. The woven or nonwoven materials used can be made from natural (e.g., wood or cotton fibers), synthetic fibers (e.g., polyester or polypropylene fibers) or combinations of natural and synthetic fibers. In some embodiments, the abrasive attachment interface is made from nylon, polyester or polypropylene.

In some embodiments, a loop abrasive attachment interface having an open structure that does not significantly interfere with the flow of particles through it is selected. In some embodiments, the abrasive attachment interface material is selected, at least in part, based on the porosity of the material.

In some embodiments, the abrasive attachment interface of the abrasive article mounting assembly of the present disclosure comprises a hook material. The material used to form the hook material useful in the present disclosure may be made in one of many different ways known to those skilled in the art. Several suitable processes for making hook material useful in making abrasive attachment interfaces useful for the present disclosure, include, for example, methods described in U.S. Pat. No. 5,058,247 (Thomas et al.) (for low cost hook fasteners); U.S. Pat. No. 4,894,060 (Nestegard) (for diaper fasteners), U.S. Pat. No. 5,679,302 (Miller et al.) (entitled "Method for making a mushroom-type hook strip for a mechanical fastener"), and U.S. Pat. No. 6,579,161 (Chesley et al.), each of which is incorporated herein by reference.

The hook material may be a porous material, such as, for example the polymer netting material reported in U.S. Publication 2004/0170801 (Seth et al.), which is incorporated herein by reference. In other embodiments, the hook material may be apertured to allow particles to pass through. Apertures can be formed in the hook material using any methods known to those skilled in the art. For example, the apertures can be cut from a sheet of hook material using, for example, a die, laser, or other perforating instruments known to those skilled in the art. In other embodiments, the hook material can be formed with apertures.

Figure 2:
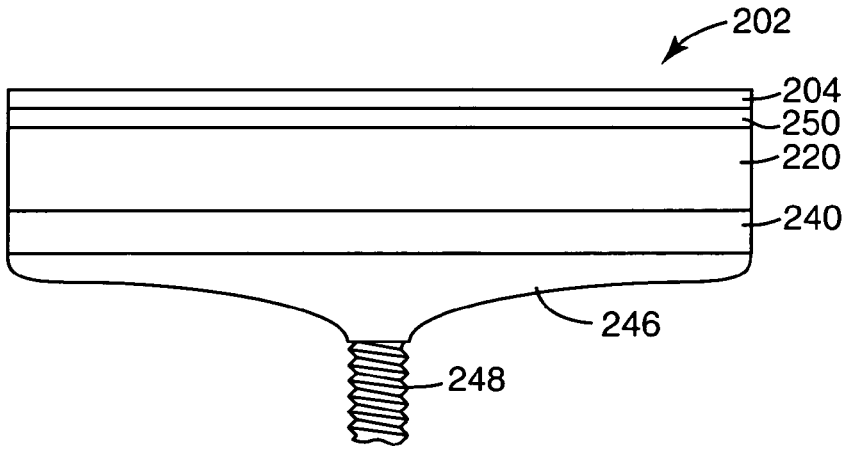
FIG. 2 is a cross-sectional view of an exemplary abrasive article mounting assembly according to the present disclosure having a third filter media layer and a mounting shaft.

FIG. 2 shows a cross-sectional view of an exemplary abrasive article mounting assembly according to the present disclosure having an optional third filter media layer. The abrasive article mounting assembly 202 has an abrasive attachment interface 204, a first filter media 220, a second filter media 240, a third filter media 250, and an assembly attachment layer 246. As shown in FIG. 2, the third filter media 250 can be located between the abrasive attachment interface 204 and the first filter media 220. In other embodiments, a third filter media can be located proximate the second filter media, either between the second filter media and the assembly attachment layer or between the second filter media and the first filter media.

The third filter media can include a wide variety of types of porous filter media as discussed in reference to the second filter media, below. The third filter media can be a fibrous material, a foam, a porous membrane, and the like.

The assembly attachment layer of the abrasive article mounting assembly of the present disclosure can be made from the same selection of materials identified above for the abrasive attachment interface. In some embodiments, the assembly attachment layer and the abrasive attachment interface comprise the same material. In some preferred embodiments, the abrasive attachment interface and the assembly attachment layer each comprise a mating portion of a two-part mechanical engagement system such that the abrasive article mounting assembly retains a similar mounting surface to the back-up pad that it is mounted to. In this fashion, a tool operator can attach the same abrasive article to either a backup pad alone or the same backup pad in combination with an abrasive article mounting assembly of the abrasive article mounting assembly of the present disclosure.

The assembly attachment layer can also be made from a molded material such as shown in FIG. 2. As shown in FIG. 2, in some embodiments, the abrasive article mounting assembly of the abrasive article mounting assembly of the present disclosure comprises an assembly attachment layer 246 comprising a mechanical mount 248 that allows the abrasive article mounting assembly to be mounted directly to an abrasive tool. The mount can be any known mounting means known to those skilled in the art, including, for example, a shaft, a threaded shaft, a hole, or a threaded hole. In other embodiments, such as shown in FIGS. 1A and 1B, for example, the abrasive article mounting assembly of the abrasive article mounting assembly of the present disclosure includes an assembly attachment layer that is configured to be attached to a back-up pad assembly mounted to the abrasive tool. In some embodiments, whether the abrasive article mounting assembly attaches directly to the tool or a backup pad, or otherwise, the assembly attachment layer contains holes, perforations, or other means of porting that allows air to flow from the abrasive tool or backup pad to the abrasive article mounting assembly.

The various layers in the abrasive article mounting assembly of the abrasive article mounting assembly of the present disclosure can be held together using any suitable form of attachment, such as, for example, glue, pressure sensitive adhesive, hot-melt adhesive, spray adhesive, thermal bonding, and ultrasonic bonding. In some embodiments, the layers are adhered to one another by applying a spray adhesive, such as, for example, "3M BRAND SUPER 77 ADHESIVE", available from 3M Company, St. Paul, Minn., to one side of the porous abrasive. In other embodiments, a hot-melt adhesive is applied to one side of a layer using either a hot-melt spray gun or an extruder with a comb-type shim. In yet further embodiments, a preformed adhesive mesh is placed between the layers to be joined.

The abrasive attachment interface and various filter media layers of the abrasive article mounting assembly of the present disclosure are affixed to one another in a manner that does not prevent the flow of particles from one layer to the next. In some embodiments, the abrasive attachment interface and various filter media layers of the abrasive article mounting assembly of the present disclosure are affixed to one another in a manner that does not substantially inhibit the flow of particles from one layer to the next. The level of particle flow through the abrasive article mounting assembly can be restricted, at least in part, by the introduction of an adhesive between the abrasive attachment interface and the first filter media, or the first filter media and the second filter media. The level of restriction can be minimized by applying the adhesive between layers in a discontinuous fashion such as, for example, as discrete adhesive areas (e.g., atomized spray or starved extrusion die) or distinct adhesive lines (e.g., hot melt swirl-spray or patterned roll coater).

The assembly attachment layer of the abrasive article mounting assembly of the present disclosure is affixed to the filter media in a manner that does not prevent the flow of air from the filter media. In some embodiments, the assembly attachment layer of the abrasive article mounting assembly of the present disclosure is affixed to the filter media in a manner that does not substantially inhibit the flow of air from the filter media. The level of air flow through the assembly attachment layer can be restricted, at least in part, by the introduction of an adhesive between an assembly attachment layer comprising a sheet material and the filter media. The level of restriction can be minimized by applying the adhesive between the sheet material of the assembly attachment layer and the filter media in a discontinuous fashion such as, for example, as discrete adhesive areas (e.g., atomized spray or starved extrusion die) or distinct adhesive lines (e.g., hot melt swirl-spray or patterned roll coater).

Adhesives useful in the present disclosure include both pressure sensitive and non-pressure sensitive adhesives. Pressure sensitive adhesives are normally tacky at room temperature and can be adhered to a surface by application of, at most, light finger pressure, while non-pressure sensitive adhesives include solvent, heat, or radiation activated adhesive systems. Examples of adhesives useful in the present disclosure include those based on general compositions of polyacrylate; polyvinyl ether; diene-containing rubbers such as natural rubber, polyisoprene, and polyisobutylene; polychloroprene; butyl rubber; butadiene-acrylonitrile polymers; thermoplastic elastomers; block copolymers such as styrene-isoprene and styrene-isoprene-styrene block copolymers, ethylene-propylene-diene polymers, and styrene-butadiene polymers; polyalphaolefins; amorphous polyolefins; silicone; ethylene-containing copolymers such as ethylene vinyl acetate, ethylacrylate, and ethylmethacrylate; polyurethanes; polyamides; polyesters; epoxies; polyvinylpyrrolidone and vinylpyrrolidone copolymers; and mixtures of the above. Additionally, the adhesives can contain additives such as tackifiers, plasticizers, fillers, antioxidants, stabilizers, pigments, diffusing particles, curatives, and solvents.

Figure 3A:
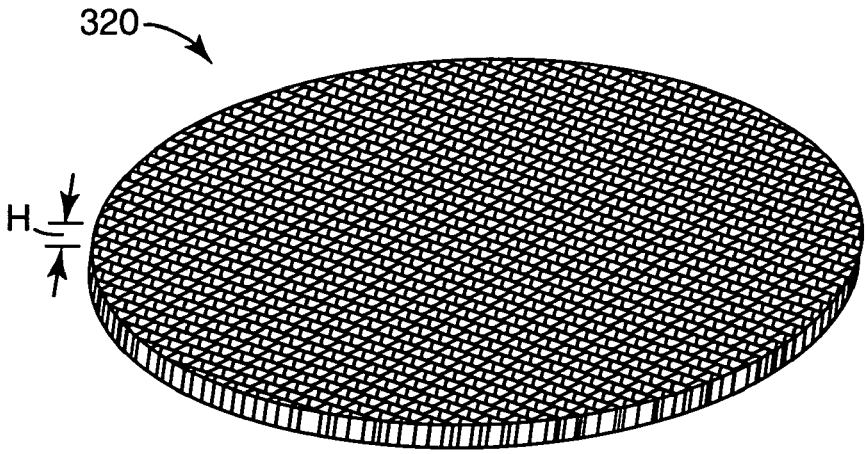
FIG. 3A is a perspective view of an exemplary first filter media layer comprising stacked film layers according to the present disclosure.
Figure 3B:
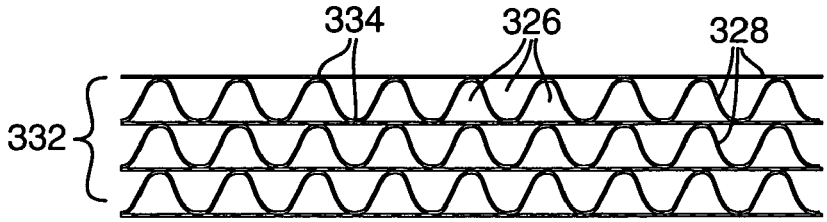
FIG. 3B is a top view of a portion of the exemplary first filter media layer shown in FIG. 3A.

FIG. 3A shows a perspective view of an exemplary first filter media layer useful in the present disclosure comprising stacked film layers. FIG. 3B shows a top view of a portion of the exemplary first filter media layer shown in FIG. 3A. As shown in FIG. 3A, the first media layer 320 has a thickness or height H. The height of the first filter media can be varied to accommodate varying applications. For example, if the particular abrading application demands an abrasive article mounting assembly with large particulate holding capacity, the height of the first filter media can be increased. The height of the first filter media can be defined by other parameters, including, for example, the desired rigidity of the abrasive article mounting assembly. In some embodiments, the first filter media of the abrasive article mounting assembly of the present disclosure is relatively rigid in comparison to the other filter media used in the abrasive article mounting assembly.

First filter media useful in the present disclosure typically have an average height of at least about 0.5 millimeter. In some embodiments, the first filter media has an average height of at least about 1 millimeter. In yet further embodiments, the first filter media has an average height of at least about 3 millimeters.

Typically, first filter media useful in the present disclosure have an average height that is less than about 30 millimeters. In some embodiments, the first filter media has an average height that is less than about 20 millimeters. In yet further embodiments, the first filter media has an average height that is less than about 10 millimeters.

As shown in FIG. 3B, an exemplary first filter media useful in the present disclosure comprises a stack 332 of polymer films that form the sidewalls 328 of channels 326 that extend through the height of the first filter media 320. The sidewalls 528 are held together at bond areas 334. First filter media that can be included in the abrasive article mounting assembly of the abrasive article mounting assembly of the present disclosure include, for example, the filter media described in U.S. Pat. No. 6,280,824 (Insley et al.), U.S. Pat. No. 6,454,839 (Hagglund et al.), and U.S. Pat. No. 6,589,317 (Zhang et al.), each of which is incorporated herein by reference.

Polymers useful in forming the polymer film sidewalls of a first filter media that can be used in the present disclosure include, but are not limited to, polyolefins such as polyethylene and polyethylene copolymers, polypropylene and polypropylene copolymers, polyvinylidene difluoride (PVDF), and polytetrafluoroethylene (PTFE). Other polymeric materials include acetates, cellulose ethers, polyvinyl alcohols, polysaccharides, polyesters, polyamides, poly(vinyl chloride), polyurethanes, polyureas, polycarbonates, and polystyrene. The polymer film layers can be cast from curable resin materials such as acrylates or epoxies and cured through free radical pathways promoted chemically, by exposure to heat, UV, or electron beam radiation. In some preferred embodiments, the polymer film layers are formed of polymeric material capable of being charged namely dielectric polymers and blends such as polyolefins or polystyrenes.

The polymer film layers may have structured surfaces defined on one or both faces as reported, for example, in U.S. Pat. No. 6,280,824 (Insley et al.), incorporated herein by reference. The structured surfaces can be in the shape of upstanding stems or projections, e.g., pyramids, cube corners, J-hooks, mushroom heads, or the like; continuous or intermittent ridges; e.g., rectangular or v-shaped ridges with intervening channels; or combinations thereof. These projections can be regular, random or intermittent or be combined with other structures such as ridges. The ridge type structures can be regular, random intermittent, extend parallel to one another, or be at intersecting or nonintersecting angles and be combined with other structures between the ridges, such as nested ridges or projections. Generally, the high aspect ratio structures can extend over all or just a region of a film. When present in a film region, the structures provide a surface area greater than a corresponding planar film.

The structured surfaces can be made by any known method of forming a structured film, such as the methods disclosed in U.S. Pat. Nos. 5,069,403 and 5,133,516, both to Marantic et al.; U.S. Pat. No. 5,691,846 to Benson et al.; U.S. Pat. No. 5,514,120 to Johnston et al.; 5,175,030 to Lu et al.; U.S. Pat. No. 4,668,558 to Barber; U.S. Pat. No. 4,775,310 to Fisher; U.S. Pat. No. 3,594,863 to Erb or U.S. Pat. No. 5,077,870 to Melbye et al. These methods are all incorporated by reference in their entirety.

Figure 4:
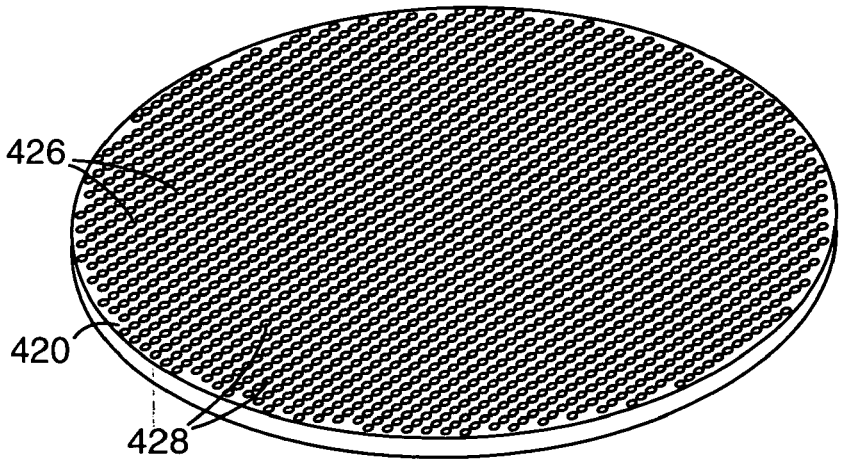
FIG. 4 is a perspective view of an exemplary first filter media layer comprising a perforated body according to the present disclosure.

FIG. 4 shows a perspective view of another exemplary first filter media layer useful in the present disclosure comprising a perforated body. As shown in FIG. 4, the first filter media 420 comprises a plurality of channels 426 with channel sidewalls 428 extending from the first surface to the second surface of the first filter media. The filter media shown in FIG. 4 can be constructed from a variety of materials, including, for example, foam, paper, or plastic, including molded thermoplastic materials and molded thermoset materials. In some embodiments, the first filter media is made from perforated porous foam material. In yet further embodiments, the first filter media is made from perforated or slit and stretched sheet materials. In some embodiments utilizing a perforated body as a first filter media, the perforated body is made from fiberglass, nylon, polyester, or polypropylene.

In some embodiments, the first filter media has discrete channels that extend from the first surface to the second surface of the first filter media. The channels can have a non-tortuous path that extends directly from the first surface to the second surface of the first filter media. The cross-sectional area of the channels can be described in terms of an effective circular diameter, which is the diameter of the largest circle that will pass through an individual channel.

First filter media useful in the present disclosure typically have channels with an average effective circular diameter of at least about 0.1 millimeter. In some embodiments, the first filter media has channels with an average effective circular diameter of at least about 0.3 millimeter. In yet further embodiments, the first filter media has channels with an average effective circular diameter of at least about 0.5 millimeters.

Typically, first filter media useful in the present disclosure have channels with an average effective circular diameter that is less than about 2 millimeters. In some embodiments, the first filter media has channels with an average effective circular diameter that is less than about 1 millimeter. In yet further embodiments, the first filter media has channels with an average effective circular diameter that is less than about 0.5 millimeters.

The filter media, including the first, second, or optional third filter media, of the abrasive article mounting assembly of the present disclosure can be electrostaticly charged. Electrostatic charging enhances the filter media's ability to remove particulate matter from a fluid stream by increasing the attraction between particles and the surface of the filter media. Non-impinging particles passing close to sidewalls are more readily pulled from the fluid stream, and impinging particles are adhered more strongly. Passive electrostatic charging is provided by an electret, which is a dielectric material that exhibits an electrical charge that persists for extended time periods. Electret chargeable polymeric materials include nonpolar polymers such as polytetrafluoroethylene (PTFE) and polypropylene.

Several methods are used to charge dielectric materials, any of which may be used to charge the filtration media of the abrasive article mounting assembly of the present disclosure, including corona discharge, heating and cooling the material in the presence of a charged field, contact electrification, spraying the web with charged particles, and impinging a surface with water jets or water droplet streams. In addition, the chargeability of the surface may be enhanced by the use of blended materials. Examples of charging methods are disclosed in the following patents: U.S. Pat. No. Re. 30,782 (van Turnhout et al.), U.S. Pat. No. Re. 31,285 (van Turnhout et al.), U.S. Pat. No. 5,496,507 (Angadjivand et al.), U.S. Pat. No. 5,472,481 (Jones et al.), U.S. Pat. No. 4,215,682 (Kubik et al.), U.S. Pat. No. 5,057,710 (Nishiura et al.) and U.S. Pat. No. 4,592,815 (Nakao).

The second filter media can include a wide variety of types of porous filter media conventionally used in filtration products, particularly air filtration products. The filter media can be a fibrous material, a foam, a porous membrane, and the like. In some embodiments, the second filter media comprises a fibrous material. The second filter media can be a fibrous filter web such as a nonwoven fibrous web, although woven and knitted webs can also be used.

In some embodiments, the second filter media comprises fibrous materials having a fiber size that is less than about 100 microns in diameter, and sometimes less than about 50 microns, and sometimes less than about 1 micron in diameter. A wide variety of basis weights can be used in the second filter media. The basis weight of the second filter media is typically in the range of about 5 grams per square meter to about 1000 grams per square meter. In some embodiments, the second filter media is in the range of about 10 grams per square meter to about 200 grams per square meter. If desired, the second filter media can include one or more layers (webs) of filter media.

The second filter media can be made from a wide variety of organic polymeric materials, including mixtures and blends. Suitable filter media includes a wide range of materials commercially available. They include polyolefins, such as polypropylene, linear low density polyethylene, poly-1-butene, poly(4-methyl-1-pentene), polytetrafluoroethylene, polytrifluorochloroethylene; or polyvinylchloride; aromatic polyarenes, such as polystyrene; polycarbonates; polyesters; and combinations thereof (including blends or copolymers). In some embodiments, materials include polyolefins free of branched alkyl radicals and copolymers thereof. In yet further embodiments, materials include thermoplastic fiber formers (e.g., polyolefins such as polyethylene, polypropylene, copolymers thereof, etc.). Other suitable materials include: thermoplastic polymers such as polylactic acid (PLA); non-thermoplastic fibers such as cellulose, rayon, acrylic, and modified acrylic (halogen modified acrylic); polyamide or polyimide fibers such as those available under the tradenames NOMEX and KEVLAR from DuPont; and fiber blends of different polymers.

In embodiments employing a nonwoven as the second filter media, the nonwoven filter media can be formed in a web by conventional nonwoven techniques including melt blowing, spunbonding, carding, air laying (dry laying), wet laying, or the like. If desired, the fibers or webs can be charged by known methods, including, for example, by use of corona discharge electrodes or high-intensity electric fields. The fibers can be charged during fiber formation, prior to or while forming the fibers into the filter web or subsequent to forming the filter web. The fibers forming the second media filter can even be charged subsequent to being joined to the first filter media. The second filter media can comprises fibers coated with a polymer binder or adhesive, including pressure sensitive adhesives.

The abrasive article mounting assemblies of the abrasive article mounting assembly of the present disclosure have been found to be efficient in collecting large amounts of particles at high rates of delivery. Although not wishing to be bound by any particular theory, it is believed that in the case of the abrasive article mounting assembly of the present disclosure, the multiple filter components can function such that a given component (e.g., the first filter media) can be aided by a secondary component (e.g., the second filter media) that can address the failure mode of the first component and compensate, keeping overall efficiency high and extending performance to a level that aligns with the performance of the abrasive article it is used with.

Advantages and other embodiments of this disclosure are further illustrated by the following examples, but the particular materials and amounts thereof recited in these examples, as well as other conditions and details, should not be construed to unduly limit this invention. All parts and percentages are by weight unless otherwise indicated.

EXAMPLES

The following abbreviations are used throughout the Examples:

Abrasive Article:

A1: A coated abrasive material, commercially available under the trade designation "IMPERIAL HOOKIT DISC 360L GRADE P320" from 3M Company. St. Paul, Minn.;

A2: Coated abrasive material "A1", having laser perforated 1.77 millimeter diameter holes at a frequency of 1.8 holes per square centimeter without the adhesive or loop backing;

A3: A screen abrasive commercially available under the trade designation "ABRANET GRADE P320" from KWH Mirka Ltd., Jeppo, Finland;

A4: Coated abrasive material "A1", having laser perforated 1.77 millimeter diameter holes at a frequency of 1.8 holes per square centimeter.

Abrasive Attachment Interface:

AT1: A loop attachment material, commercially available under the trade designation "70 G/M$^2$ TRICOT DAYTONA BRUSHED NYLON LOOP FABRIC" from Sitip SpA, Gene, Italy;

AT2: The hook component of a releasable mechanical fastener system was made according to the method described in U.S. Pat. No. 6,843,944 (Bay et al.), having the following dimensions: 5 mils (127 micrometers) thickness; stem diameter 14 mils (355.6 micrometers); cap diameter 30 mils (0.76 millimeters); stem height 20 mils (508 micrometers) and a frequency of 340 stems/inch$^2$ (52.7 stems/cm$^2$. The attachment media was perforated with a series of uniformly distributed holes, ⅛th inch (3.18 millimeters) diameter, using a 10.6 micrometer wavelength $CO_2$ laser, from Coherent, Inc., Santa Clara, Calif. The perforation frequency was 2.19 holes/cm$^2$, resulting in a backing having a cumulative open area of 20%; and AT3: A polypropylene mesh hook backing material was made according to the methods reported by U.S. Publication 2004/0170802 (Seth et al.), the disclosure of which is incorporated herein by reference. The die geometry was similar to the die used to make the polymer netting shown in FIG. 10 of U.S. Publication 2004/0170802 (Seth et al.). However, in contrast to the article shown in FIG. 10 of U.S. Publication 2004/0170802 (Seth et al.), the hooks on the first plurality of strands were not cut and therefore, were reduced to approximately one-third there molded size after longitudinally stretching of the first strands at a stretch ratio of about 3. The uncut hooks of the first plurality of strands formed the surface for attaching the polymer netting to the screen abrasive. The second plurality of strands had a final thickness of approximately 9 mils (228.6 micrometers), and comprised a plurality of hooks having a stem height of 29 mils (736.6 micrometers), stem diameter 10 mils (254 micrometers) and stem frequency of approximately 450 stem per square inch (70 stems per square centimeter). The open space of the polymer netting accounted for 80 percent of the total surface area of the area formed by the perimeter of the polymer netting.

Filter Media.

F1: 5 millimeter thick corrugated polypropylene multilayer filter media, commercially available under the trade designation "3M HIGH AIRFLOW AIR FILTRATION MEDIA (HAF); 5 MM" from 3M Company, St. Paul, Minn.;

F2: 10 millimeter thick corrugated polypropylene multilayer filter media, commercially available under the trade designation "3M HIGH AIRFLOW AIR FILTRATION MEDIA (HAF); 10 MM" from 3M Company;

F3: A polyurethane blown micro fiber web, 70 grams per square meter basis weight; and F4: An electrostatically charged staple fiber web, 100 grams per square meter basis weight, commercially available under the trade designation "FILTRETE G100" from 3M Company, wherein 2 percent of its overall surface area was uniformly point bonded using ultrasonic welding.

Sample Preparation

The following abbreviations are used to describe the filter-attachment laminate:

L1 is the abrasive attachment interface;

L5 is the assembly attachment layer;

L2 and L4 are the filter media laminated to L1 and L5 respectively;

L3 is the filter media laminated between attachment media filter media L2 and L4.

2-Layer Laminate 2.5 milligrams per square centimeter of "SUPER 77 SPRAY ADHESIVE", commercially available from 3M Company, St. Paul, Minn., was applied to a sheet of loop attachment media L5 and allowed to dry for 30 seconds at 25 degrees Celsius, then laminated to a similar size sheet of filter media L4.

4-Layer Laminate

The process described for the 2-layer laminate was repeated, wherein two filter media were laminated together with the "SUPER 77 SPRAY ADHESIVE" and allowed to dry for 30 seconds prior to laminating to the hook attachment media L1. This 4-layer laminate was then die cut into 5-inch (12.7 cm) diameter samples.

5-Layer Laminate

The process described for the 4-layer laminate was repeated, wherein three filter media were laminated together in a similar fashion with the "SUPER 77 SPRAY ADHESIVE" prior to laminating to the hook attachment media L1. This 5-layer laminate was then die cut into 5-inch (12.7 cm) diameter samples.

Sanding Test

A 5-inch (12.7 centimeter) abrasive article was affixed to the abrasive article mounting assembly and then the assembly was attached to a 5-inch (12.7 cm) diameter by ⅜-inch (0.95 cm) thick foam back up pad, available under the trade designation "DYNABRADE BACK-UP PAD MODEL 56320" from Dynabrade Corporation, Clarence, N.Y. The assembled backup pad, abrasive article mounting assembly, and abrasive disc was weighed, then mounted onto a dual-action orbital sander, model "21038", obtained from Dynabrade Corporation, Clarence, N.Y. The central dust extraction vacuum line was detached from the sander.

The abrasive surface of the abrasive disc was brought into contact with a pre-weighed 18-inch by 30 inch (45.7 by 76.2 cm) gel-coated fiberglass reinforced plastic panel, from Whitebear Boatworks, White Bear Lake, Minn. The sander was run at 91.5 pounds per square inch (630.9 kilopascals (Kpa)) air line pressure and a down force of 15 pounds force (66.7 N) for 45 seconds. An angle of zero degrees to the surface of the workpiece was used. Each test consisted of 24 overlapping transverse passes, 21 inches (53.3 cm) in length, resulting in an evenly sanded 18 by 26 inch (45.7 by 66.0 cm) area of test panel. Tool motion over the face of the panel was at a rate of 5 inches/sec. (12.7 cm./sec.) for both X and Y directions. Total travel length was 517 inches (13.13 m.). After the final sanding pass, the test panel and test sample assembly with backup pad were re-weighed. The test panel was then cleaned and weighed again. After removing the sample, the backup pad and tool were cleaned in preparation for another test.

The following measurements were made per each test and reported as an average:

"Cut": weight, in grams, removed from the test panel.

"Retain": weight, in grams, of swarf captured in the sample with the backup pad and abrasive attached.

"Surface": weight, in grams, of swarf remaining on the test panel surface.

"Lost": weight, in grams, of swarf that was unaccounted for and not contained in the value for "Retain" or in the value for "Surface".

"Capture Percent": ratio of "Retain" over "Cut"

Examples 1-4

Examples 1-4 were prepared according to the 4-layer laminate method. Specific constructions and sanding test results are listed in Table 1.

TABLE 1

| | | Filter-Attachment Laminate | | | | Sample | Cut | Retain | Surface | Lost | |
|---|---|---|---|---|---|---|---|---|---|---|---|
| Example | Abrasive | L1 | L2 | L4 | L5 | Size | (grams) | (grams) | (grams) | (grams) | Capture % |
| 1 | A3 | AT3 | F1 | F4 | AT1 | 1 | 5.28 | 4.48 | 0.13 | 0.67 | 84.8 |
| 2 | A3 | AT2 | F1 | F4 | AT1 | 1 | 5.05 | 4.56 | 0.13 | 0.36 | 90.3 |
| 3 | A4 | AT3 | F1 | F4 | AT1 | 1 | 4.51 | 4.24 | 0.16 | 0.11 | 94.0 |
| 4 | A4 | AT2 | F1 | F4 | AT1 | 1 | 4.43 | 4.28 | 0.10 | 0.05 | 96.6 |

Examples 5-8

Examples 5-8 were prepared according to the 5-layer laminate method. Specific constructions and sanding test results are listed in Table 2.

TABLE 2

| | | Filter-Attachment Laminate | | | | | Sample | Cut | Retain | Surface | Lost | Capture |
|---|---|---|---|---|---|---|---|---|---|---|---|---|
| Example | Abrasive | L1 | L2 | L3 | L4 | L5 | Size | (grams) | (grams) | (grams) | (grams) | % |
| 5 | A3 | AT3 | F1 | F4 | F3 | AT1 | 1 | 6.16 | 5.47 | 0.28 | 0.41 | 88.8 |
| 6 | A3 | AT2 | F1 | F4 | F3 | AT1 | 2 | 4.08 | 3.81 | 0.11 | 0.15 | 93.5 |
| 7 | A4 | AT3 | F1 | F4 | F3 | AT1 | 1 | 4.43 | 4.03 | 0.29 | 0.11 | 91.0 |
| 8 | A4 | AT2 | F1 | F4 | F3 | AT1 | 1 | 4.24 | 4.00 | 0.15 | 0.09 | 94.3 |

Examples 9-10

Examples 9-10 were prepared according to the 2-layer laminate method. "SUPER 77 SPRAY ADHESIVE" was applied to coated abrasive A2, allowed to dry for 60 seconds, attached to the 2-layer laminate, then die cut into 5-inch (12.7 cm) diameter samples. Specific constructions and sanding test results are listed in Table 2.

TABLE 3

| | | Filter-Attachment Laminate | | Sample | Cut | Retain | Surface | Lost | Capture |
|---|---|---|---|---|---|---|---|---|---|
| Example | Abrasive | L4 | L5 | Size | (grams) | (grams) | (grams) | (grams) | % |
| 9 | A2 | F2 | AT1 | 4 | 6.56 | 4.12 | −0.03 | 2.47 | 63.3 |
| 10 | A2 | F1 | AT1 | 2 | 5.95 | 3.77 | 0.22 | 1.96 | 64.0 |

Comparatives A-F.

Abrasives A1-A3, without lamination to either the filter media or the loop attachment material, were used as Comparatives. Sanding test results are listed in Table 4.

TABLE 4

| Comparative | Abrasive | Sample Size | Cut (grams) | Retain (grams) | Surface (grams) | Lost (grams) | Capture % |
|---|---|---|---|---|---|---|---|
| A | A1 | 1 | 2.92 | 0.78 | 0.26 | 1.88 | 26.7 |
| B | A1 | 1 | 3.10 | 0.51 | 0.20 | 2.39 | 16.5 |
| C | A4 | 1 | 5.82 | 0.47 | 0.06 | 5.29 | 8.1 |
| D | A4 | 1 | 6.37 | 0.49 | 0.24 | 5.64 | 7.7 |
| E | A3 | 1 | 7.81 | 0.32 | 0.18 | 7.31 | 4.1 |
| F | A3 | 1 | 7.55 | 0.30 | 0.14 | 7.11 | 4.0 |

It is to be understood that even in the numerous characteristics and advantages of the abrasive article mounting assembly of the present disclosure set forth in above description and examples, together with details of the structure and function of the invention, the disclosure is illustrative only. Changes can be made to detail, especially in matters of shape, size and arrangement of the filter media layers and methods of making and using within the principles of the invention to the full extent indicated by the meaning of the terms in which the appended claims are expressed and the equivalents of those structures and methods.

What is claimed is:

1. An abrasive article mounting assembly comprising:

an abrasive attachment interface comprising a first surface, and a second surface opposite said first surface wherein said abrasive attachment interface is porous;

a first filter media having a first surface and a second surface opposite said first surface, said first surface of said first filter media proximate said second surface of said abrasive attachment interface, said first filter media comprising a plurality of discrete channels formed by a plurality of channel sidewalls, said plurality of discrete channels extending from said first surface of said first filter media to said second surface of said first filter media, said first filter media having a height in the range of 1 to 20 millimeters;

a second filter media having a first surface and a second surface opposite said first surface, said first surface of said second filter media proximate said second surface of said first filter media; and an assembly attachment layer proximate said second surface of said second filter media;

wherein said abrasive attachment interface cooperates with said plurality of discrete channels to allow a flow of particles from said first surface of said abrasive attachment interface to said second filter media.

2. The abrasive article mounting assembly of claim 1 wherein said abrasive attachment interface comprises a loop portion of a two-part mechanical engagement system.

3. The abrasive article mounting assembly of claim 2 wherein said loop portion comprises a nonwoven material.

4. The abrasive article mounting assembly of claim 1 wherein said abrasive attachment interface comprises a hook portion of a two-part mechanical engagement system.

5. The abrasive article mounting assembly of claim 4 wherein said hook portion comprises a perforated hook material.

6. The abrasive article mounting assembly of claim 1 wherein said plurality of channel sidewalls comprise a polymer film.

7. The abrasive article mounting assembly of claim 6 wherein said polymer film comprises a polymer selected from the group consisting of polypropylene, polyethylene, polytetrafluoroethylene, and combinations thereof.

8. The abrasive article mounting assembly of claim 6 wherein said polymer film comprises a structured surface.

9. The abrasive article, mounting assembly of claim 6 wherein said polymer film comprises an electrostatic charge.

10. The abrasive article mounting assembly of claim 6 wherein said plurality of discrete channels comprise an average effective circular diameter of at least 0.1 millimeter.

11. The abrasive article mounting assembly of claim 6 wherein said second filter media comprises a nonwoven material.

12. The abrasive article mounting assembly of claim 11 wherein said nonwoven material comprises polyolefin fibers and has a basis weight in the range of 10 to 200 grams per square meter.

13. The abrasive article mounting assembly of claim 11 wherein said nonwoven material comprises an adhesive.

14. The abrasive article mounting assembly of claim 11 wherein said nonwoven material comprises an electrostatic charge.

15. The abrasive article mounting assembly of claim 1 further comprising a third filter media positioned between said abrasive attachment interface and said first filter media.

16. The abrasive article mounting assembly of claim 15 wherein said third filter media comprises a nonwoven filter.

17. The abrasive article mounting assembly of claim 1 wherein said abrasive attachment interface is affixed to said first filter media with an adhesive.

18. The abrasive article mounting assembly of claim 1 wherein said second surface of said abrasive attachment interface and said first surface of said first filter media are coextensive.

19. The abrasive article mounting assembly of claim 1 wherein said second surface of said first filter media and said first surface of said second filter media are coextensive.

20. The abrasive article mounting assembly of claim 1 wherein said assembly attachment layer is a pressure sensitive adhesive.

21. The abrasive article mounting assembly of claim 1 wherein said abrasive attachment interface comprises a loop portion or a hook portion of a two-pan mechanical engagement system.

22. The abrasive article mounting assembly of claim 1 wherein said abrasive attachment interface comprises a mechanical mount.

23. An abrasive article mounting assembly comprising:

an abrasive attachment interface comprising a first surface, and a second surface opposite said first surface, wherein said abrasive attachment interface is porous;

a first filter media having a first surface and a second surface opposite said first surface, said first surface of said first filter media affixed to said second surface of said abrasive attachment interface, said first filter media comprising a plurality of channels formed by a plurality of polymer films configured as a stack and affixed to one another, said plurality of channels extending from said first surface of said first filter media to said second, surface of said first filter media;

a second filter media having a firs surface and a second surface opposite said first surface, said first surface of said second filter media proximate said second surface of said first filter media; and an assembly attachment layer proximate said second surface of said second filter media;

wherein said abrasive attachment interface cooperates with said plurality of channels to allow a flow of particles from said first surface of said abrasive attachment interface to said second filter media.

24. The abrasive article mounting assembly of claim 23 wherein said plurality of polymer films comprises a polymer selected from the group consisting of polypropylene, polyethylene, polytetrafluoroethylene, and combinations thereof.

25. The abrasive article mounting assembly of claim 23 wherein said plurality of polymer films comprises a structured surface.

26. The abrasive article mounting assembly of claim 23 wherein said plurality of polymer films comprises an electrostatic charge.

27. The abrasive article mounting assembly of claim 23 wherein said plurality of channels comprise an average effective circular diameter of at least 0.1 millimeter.

28. A method of making an abrasive article mounting assembly comprising:

providing an abrasive attachment interface comprising a first surface, and a second surface opposite said first surface, wherein said abrasive attachment interface is porous;

providing a first filter media comprising a plurality of channels formed by a plurality of polymer films configured as a stack and affixed to one another, said plurality of channels extending from said first surface of said first filter media to said second surface of said first filter media;

affixing said first filter media to said second surface of said abrasive attachment interface;

affixing a second filter media to said first filter media; and affixing an assembly attachment layer proximate said second filter media.

29. The method of making an abrasive article mounting assembly according to claim 28 wherein said assembly attachment layer comprises a loop portion or a hook portion of a two-part mechanical engagement system, and adhesive is used to affix said assembly attachment layer.

30. The method of making an abrasive article mounting assembly according to claim 28 wherein said abrasive attachment interface comprises a loop portion or a hook portion of a two-part mechanical engagement system, and adhesive is used to affix said abrasive attachment interface.

31. The method of claim 28 wherein adhesive is used to affix said first filter media to said second surface of said abrasive attachment interface.

32. The method of claim 28 wherein adhesive is used to affix said second filter media to said first filter media.

33. The abrasive article mounting assembly of claim 1 comprising an abrasive article releasably affixed to said first surface of said abrasive attachment interface.

34. The abrasive article mounting assembly of claim 33 comprising a rotary tool and said assembly attachment layer is releasably secured to said rotary tool.

* * * * *

UNITED STATES PATENT AND TRADEMARK OFFICE

CERTIFICATE OF CORRECTION

PATENT NO. : 7,390,244 B2
APPLICATION NO. : 11/229277
DATED : June 24, 2008
INVENTOR(S) : Edward J. Woo It is certified that error appears in the above-identified patent and that said Letters Patent is hereby corrected as shown below:

Column 13
Line 32, In Claim 1, after “surface” insert -- , --. (second occurrence)

Column 14
Line 7, In Claim 9, delete “article,” and insert -- article -- therefor.
Line 44, In Claim 21, delete “two-pan” and insert -- two-part -- therefor.
Line 60, In Claim 23, after “second” delete “,”.
Line 62, In Claim 23, delete “firs” and insert -- first -- therefor.

Signed and Sealed this

Twenty-seventh Day of January, 2009

JOHN DOLL
*Acting Director of the United States Patent and Trademark Office*